US007290995B2

(12) United States Patent
Ohnishi et al.

(10) Patent No.: US 7,290,995 B2
(45) Date of Patent: Nov. 6, 2007

(54) TANDEM TYPE TROCHOID PUMP AND METHOD OF ASSEMBLING THE SAME

(75) Inventors: Hideaki Ohnishi, Kanagawa (JP); Yasushi Watanabe, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 89 days.

(21) Appl. No.: 11/287,459

(22) Filed: Nov. 28, 2005

(65) Prior Publication Data

US 2006/0120908 A1 Jun. 8, 2006

(30) Foreign Application Priority Data

Dec. 3, 2004 (JP) ..... 2004-351887

(51) Int. Cl.
*F04C 2/10* (2006.01)
*F04C 11/00* (2006.01)
*B23P 15/00* (2006.01)

(52) U.S. Cl. ..... 418/171; 29/888.02; 418/10; 418/166

(58) Field of Classification Search ..... 418/1, 418/10, 7, 58, 212, 166, 5, 171; 29/888.02, 29/888.023, 888.024, 889
See application file for complete search history.

(56) References Cited

U.S. PATENT DOCUMENTS

| | | | | |
|---|---|---|---|---|
| 3,244,111 | A * | 4/1966 | Shelhart | 418/133 |
| 5,797,734 | A * | 8/1998 | Kizer et al. | 418/9 |
| 6,643,927 | B2 * | 11/2003 | Murayama et al. | 29/888.02 |
| 6,679,692 | B1 * | 1/2004 | Feuling | 418/171 |
| 2003/0026722 | A1 * | 2/2003 | Takagi et al. | 418/171 |

FOREIGN PATENT DOCUMENTS

| | | |
|---|---|---|
| JP | 03-005990 U | 1/1991 |

* cited by examiner

*Primary Examiner*—Thomas Denion
*Assistant Examiner*—Mary A Davis
(74) *Attorney, Agent, or Firm*—Foley & Lardner LLP

(57) ABSTRACT

A tandem type trochoid pump is comprised of a drive shaft having a non-circular end portion, a spacer positioned between a first trochoid pump and a second trochoid pump in a housing body, a first fixing portion for fixing a first inner rotor of the first trochoid pump to the drive shaft in a rotational direction, and a second fixing portion for fixing a second inner rotor of the second trochoid pump to the drive shaft in the rotational direction.

19 Claims, 10 Drawing Sheets

TANDEM TYPE TROCHOID PUMP AND METHOD OF ASSEMBLING THE SAME

BACKGROUND OF THE INVENTION

The present invention relates to a tandem type trochoid pump employing two sets of trochoid pumps and a method of assembling the tandem type trochoid pump.

Japanese Published Utility Model No. 3-5990 has proposed a tandem type trochoid pump which is arranged to drive two trochoid pumps by applying a rotational force to a drive shaft of the pump. The two trochoid pumps are set such that a timing of communicating an operation chamber and a discharge port of one pump is differentiated from a timing of the other pump, in order to decrease a pulse pressure of the oil pump.

Since two inner rotors of the two pumps are arranged so as to integrally rotate with the drive shaft, it is difficult to respectively install the two inner rotors having different phases into corresponding outer rotors. In order to solve this difficulty, Japanese Published Utility Model No. 3-5990 has employed an intermediate casing for sub-assembling one of the two pumps to improve a workability during assembly process.

SUMMARY OF THE INVENTION

However, such a known tandem type pump has had a problem that a housing of the pump becomes large due to the using of the intermediate casing.

It is therefore an object of the present invention to provide a tandem type trochoid pump which improves a workability during an assembly process of the pump while avoiding upsizing of the pump.

Another objection of the present invention is to provide a method of assembling the above tandem type pump.

An aspect of the present invention resides in a tandem type trochoid pump which comprises a housing body of a cylindrical shape comprising an opening end portion and a bottom end portion; a pump cover sealing the opening end portion; a first trochoid pump disposed adjacent to the bottom end portion, the first trochoid pump comprising a first inner rotor and a first outer rotor; a second trochoid pump disposed adjacent to the opening end portion in tandem with the first trochoid pump, a phase of the second trochoid pump being different from a phase of the first trochoid pump, the second trochoid pump comprising a second inner rotor and a second outer rotor; a drive shaft comprising a non-circular end portion, the drive shaft receiving a rotational force at the other end portion thereof; a spacer disposed between the first and second trochoid pumps in the housing body, the drive shaft rotatably penetrating the spacer; a first fixing portion for fixing the first inner rotor to the drive shaft in a rotational direction of the drive shaft, the first fixing portion being constructed by the non-circular end portion and a non-circular hole which is formed at an inner circumference of the first inner rotor and engageable with the non-circular portion; and a second fixing portion for fixing the second inner rotor to the drive shaft in the rotational direction of the drive shaft, the second fixing portion being constructed by a through hole which is formed at a second-inner-rotor position of the drive shaft and which extends in a diametrical direction of the drive shaft, a pin which is inserted in the through hole, and a pin groove which is formed on the second inner rotor and which is engaged with the pin.

Another aspect of the present invention resides in a tandem type inscribed gear pump which comprises: a housing body of a cylindrical shape comprising an opening end portion and a bottom end portion; a pump cover sealing the opening end portion; a first inscribed gear pump disposed adjacent to the bottom end portion, the first inscribed gear pump comprising a first inner rotor and a first outer rotor; a second inscribed gear pump disposed adjacent to the opening end portion in tandem with the first inscribed gear pump, a phase of the second inscribed gear pump being different from a phase of the first inscribed gear pump, the second inscribed gear pump comprising a second inner rotor and a second outer rotor; a drive shaft comprising a non-circular end portion, the drive shaft receiving a rotational force at the other end portion thereof; a spacer disposed between the first and second trochoid pumps in the housing body, the drive shaft rotatably penetrating the spacer; a first fixing portion for fixing the first inner rotor to the drive shaft in a rotational direction of the drive shaft, the first fixing portion being constructed by the non-circular end portion and a non-circular hole which is formed at an inner circumference of the first inner rotor and engageable with the non-circular portion; and a second fixing portion for fixing the second inner rotor to the drive shaft in the rotational direction of the drive shaft, the second fixing portion being constructed by a through hole which is formed at a second-inner-rotor position of the drive shaft and which extends in a diametrical direction of the drive shaft, a pin which is inserted in the through hole, and a pin groove which is formed on the second inner rotor and which is engaged with the pin.

A further aspect of the present invention resides in a method of assembling a tandem type trochoid pump which comprises a housing body of a cylindrical shape comprising an opening end portion and a bottom end portion; a pump cover sealing the opening end portion of the housing body; a first trochoid pump disposed adjacent to the bottom end portion and comprising a first inner rotor and a first outer rotor; a second trochoid pump disposed adjacent to the opening end portion in tandem with the first trochoid pump, a phase of the second trochoid pump being different from a phase of the first trochoid pump, the second trochoid pump comprising a second inner rotor and a second outer rotor; a drive shaft comprising a non-circular end portion, the drive shaft receiving a rotational force at the other end portion thereof; a spacer which is disposed between the first and second trochoid pumps in the housing body, the drive shaft rotatably penetrating the spacer; a first fixing portion fixing the first inner rotor to the drive shaft in a rotational direction of the drive shaft, the first fixing portion being constructed by the non-circular end portion and a non-circular hole which is formed at an inner circumference of the first inner rotor and engageable with the non-circular portion; and a second fixing portion for fixing the second inner rotor to the drive shaft in the rotational direction of the drive shaft, the second fixing portion being constructed by a through hole which is formed at a second-inner-rotor position of the drive shaft and extends in a diametrical direction of the drive shaft, a pin which is inserted in the through hole, and a pin groove which is formed on the second inner rotor and which is engaged with the pin. The method comprises a first step of installing the first outer rotor, the first inner rotor and the spacer in the housing body; a second step of inserting the drive shaft in the second inner rotor and integrally connecting the drive shaft and the second inner rotor by means of the second fixing portion; a third step of inserting the drive shaft in the spacer and the first inner rotor and fixedly connecting the drive shaft and the first inner rotor in a rotational direction of the drive shaft by means of the first fixing portion; and a fourth step of installing the second outer rotor in the housing body.

The other objects and features of this invention will become understood from the following description with reference to the accompanying drawings.

DETAILED DESCRIPTION OF THE INVENTION

Hereinafter, there is discussed a best mode of the present invention, on the basis of a first embodiment.

Figure 1:
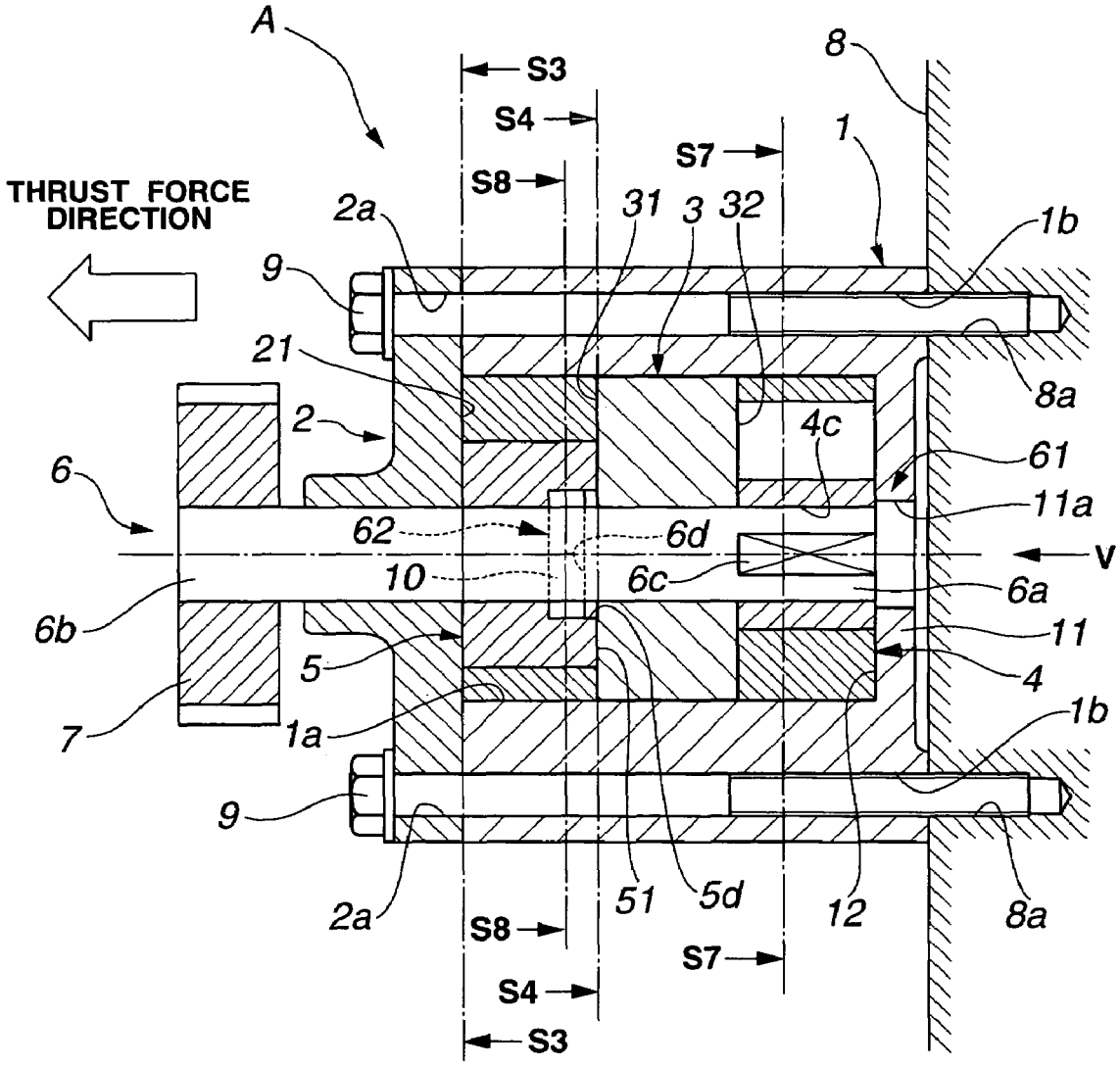
FIG. 1 is a cross-sectional view showing a tandem type trochoid pump according to a first embodiment present invention.
Figure 2:
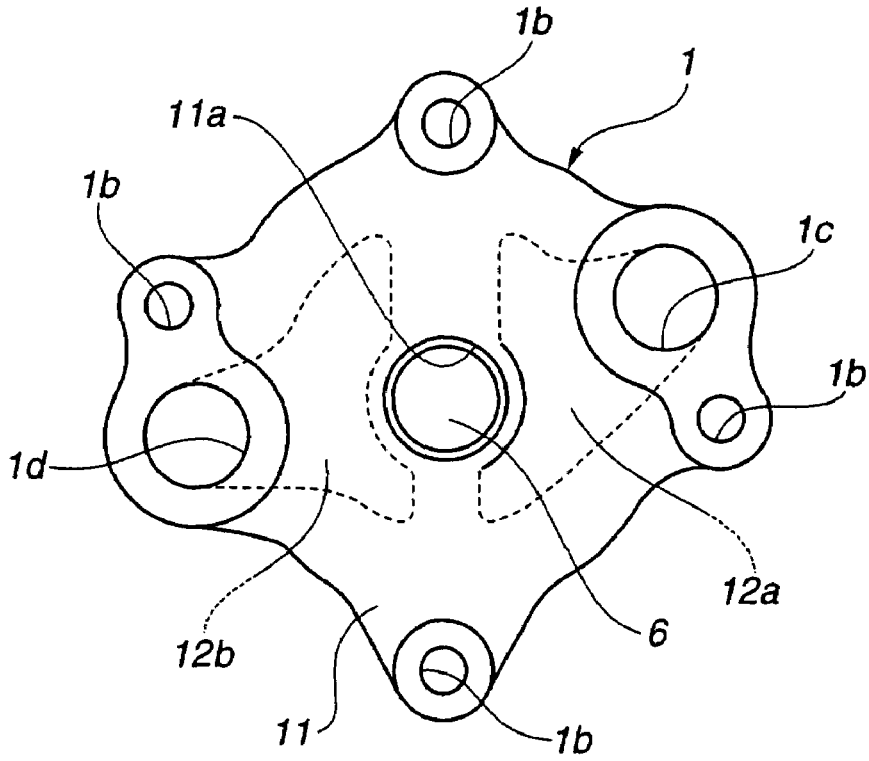
FIG. 2 is a view as viewed in the direction of the arrow V in FIG. 1.

FIG. 1 is a longitudinal cross-sectional view showing a construction of a tandem type trochoid pump (tandem type inscribed gear pump or tandem rotor-type pump) according to a first embodiment of the present invention. FIG. 2 is a view taking in the direction V of FIG. 1. The first embodiment exemplifies the application of the tandem trochoid pump A according to the present invention to a lubrication oil pump for an internal combustion engine.

Tandem type trochoid pump A of the first embodiment comprises a housing body 1, a pump cover 2, a spacer 3, a first trochoid pump (first inscribed gear pump) 4, a second trochoid pump (second inscribed gear pump) 5, a drive shaft 6, and a helical gear 7.

Housing body 1 is formed into a cylindrical shape. Housing body 1 has an opening portion 1*a* at an end near helical gear 7 and a bottom portion 11 at the other end near an engine housing 8. As shown in FIG. 2, housing body 1 has a suction inlet 1*c* and a discharge outlet 1*d* which are formed in the axial direction. Suction inlet 1*c* is fluidly communicated with a not-shown oil pan of storing oil through a not-shown oil passage formed in engine housing 8. Discharge outlet 1*d* is fluidly communicated with a not-shown oil filter through an oil passage formed in engine housing 8. Engine oil filtered by the oil filter is supplied to lubricating portions of bearings, camshafts and valves of the engine.

A press-fit supporting jig 11*b* for supporting a first end portion 6*a* of a drive shaft 6 during an assembly process is inserted into bottom portion 11 of housing body 1, as shown in FIG. 11 C. An insertion hole 11*a* for putting first end portion 6*a* and bottom portion 11 into a non-contact state is formed at bottom portion 11 of housing body 1. A suction port 12*a* communicated with suction inlet 1*c* and a discharge port 12*b* communicated with discharge outlet 1*d* are formed on a first-trochoid-pump facing surface 12 of bottom portion 11, which contacts with first trochoid pump 4.

Figure 3:
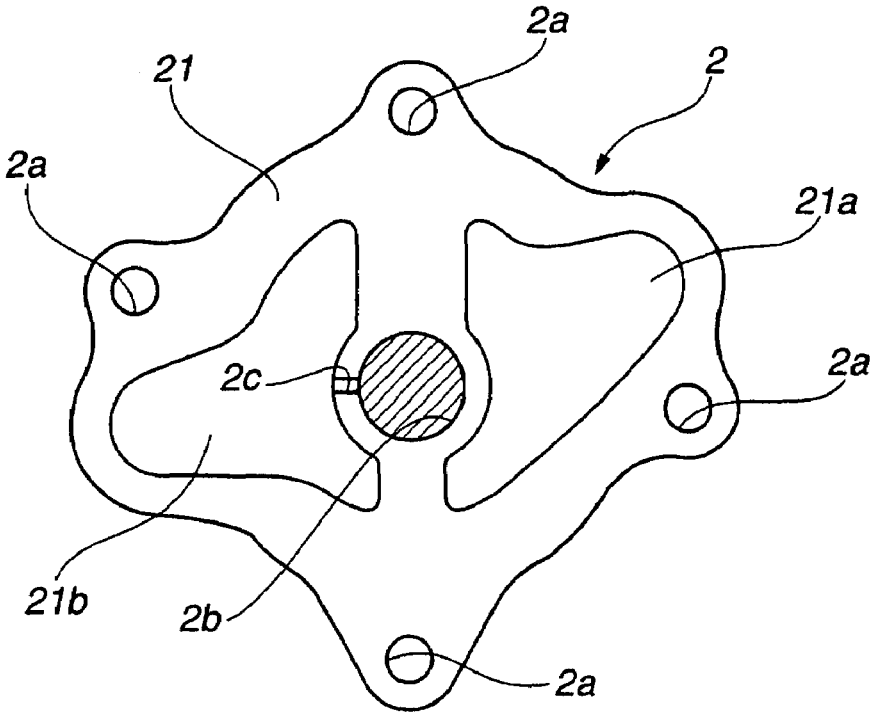
FIG. 3 is a cross-sectional view along line S3-S3 of FIG. 1, showing a second-pump-facing surface of a pump cover.

Pump cover 2 seals (sealingly covers) the opening portion 1*a* of housing body 1. A bearing portion 2*b* for rotatably supporting the drive shaft 6 is formed at a center of pump cover 2. As shown in FIG. 3, a suction port 21*a* communicated with suction inlet 1*c* and a discharge portion 21*b* communicated with discharge outlet 1*d* are formed on a second-trochoid-pump facing surface of pump cover 2, which contacts with second trochoid pump 5. Further, a lubrication groove 2*c* for lubricating the bearing portion 2*b* is formed in pump cover 2 so as to communicate discharge port 21*b* and bearing portion 2*b*.

Bolt holes 1*b* and 2*a* are formed at portions of housing body 1 and pump cover 2 which correspond to four female thread portions 8*a* are formed in engine housing 8, respectively. Housing body 1 and pump cover 2 are fixedly connected to the engine housing by tightening four bolts 9 with female thread portions 8*a* of engine housing 8 through bolt holes 1*b* and 2*a*.

Figure 4:
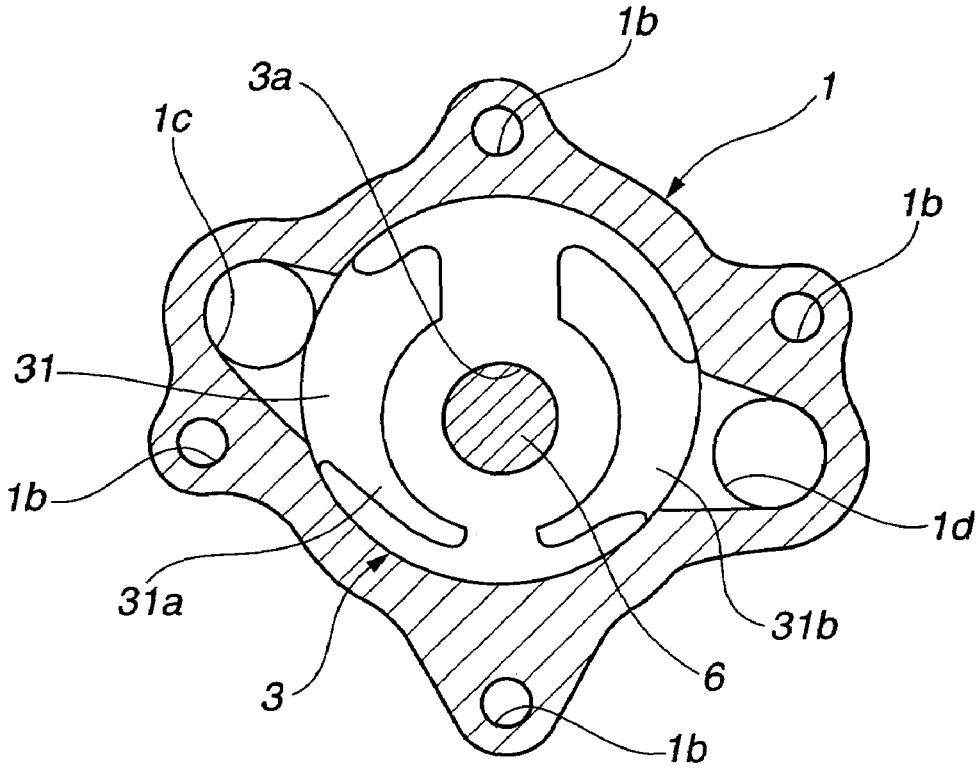
FIG. 4 is a cross-sectional view along line S4-S4 of FIG. 1, showing a second-pump-facing surface of a spacer.
Figure 5:
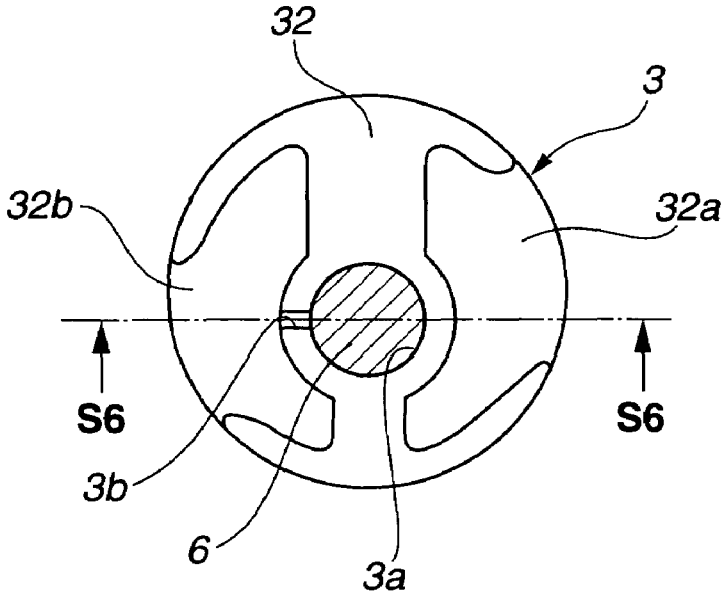
FIG. 5 is a view showing a first-pump-facing surface of the spacer.
Figure 6:
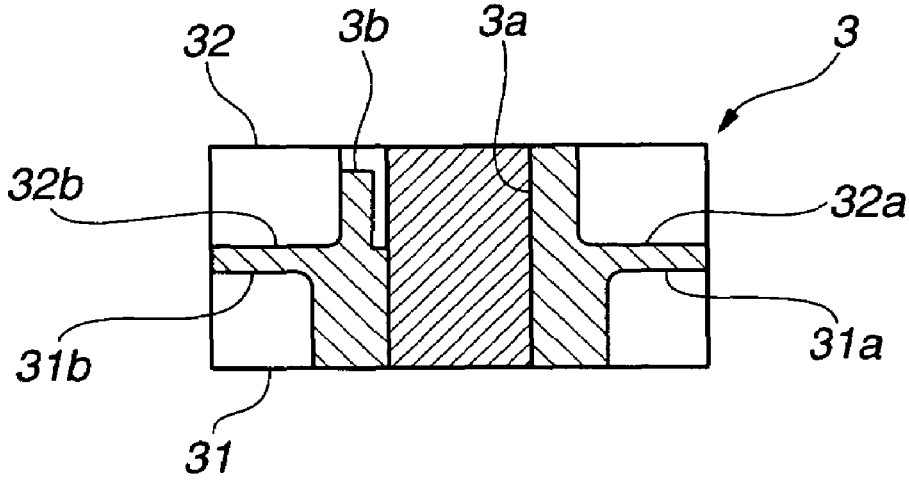
FIG. 6 is a cross-sectional view along line S6-S6 of FIG. 5.

FIG. 4 is a cross-sectional view substantially taken on the line S4-S4 of FIG. 1, showing a second-pump-facing surface 31 of a spacer 3. FIG. 5 is a view showing a first-pump-facing surface 32 of spacer 3. FIG. 6 is a cross-sectional view substantially taken on the line S6-S6 of FIG. 5.

Spacer 3 partitions first trochoid pump 4 and second trochoid pump 5, and supports drive shaft 6. That is, spacer 3 is disposed between first trochoid pump 4 and the second trochoid pump 5 in housing body 1. A bearing portion 3*a* for rotatably supporting the drive shaft 6 is formed at a center portion of spacer 3.

A suction port 31*a* communicated with suction inlet 1*c* and a discharge port 31*b* communicated with discharge outlet 1*d* are formed on second-pump-facing surface 21 of spacer 3, which contacts with second trochoid pump 5.

A suction port 32*a* communicated with suction inlet 1*c* and a discharge port 32*b* communicated with discharge outlet 1*d* are formed on first-pump-facing surface 32 of spacer 3, which contacts with first trochoid pump 4. Further a lubrication groove 3*b* for lubricating the bearing portion 3*a* is formed in spacer 3 so as to communicate bearing portion 3*a* and discharge port 32*b*.

Figure 7:
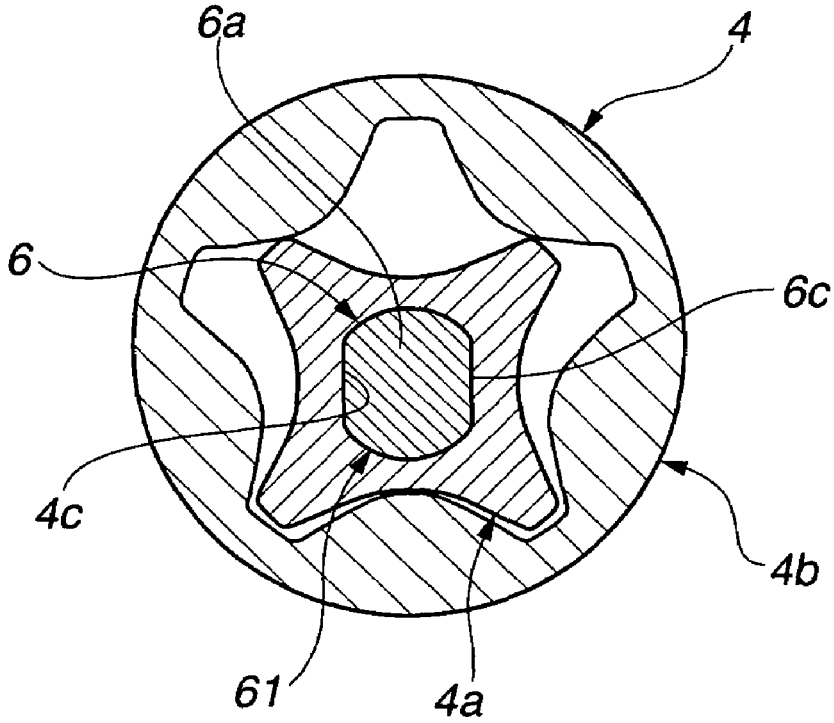
FIG. 7 is a cross-sectional view along line S7-S7 of FIG. 1, showing a first trochoid pump.

FIG. 7 is a cross-sectional view substantially taken on the line S7-S7 of FIG. 1, showing first trochoid pump 4. First trochoid pump 4 is disposed in housing body 1 so as to face with bottom portion 11. First trochoid pump 4 comprises a first inner rotor 4*a* functioning as a driver rotor and a first outer rotor 4*b* functioning as a driven rotor. An engagement hole (non-circular hole) 4*c*, which engages with a first end portion 6*a* of drive shaft 6, is formed at an inner periphery of first inner rotor 4*a*.

Figure 8:
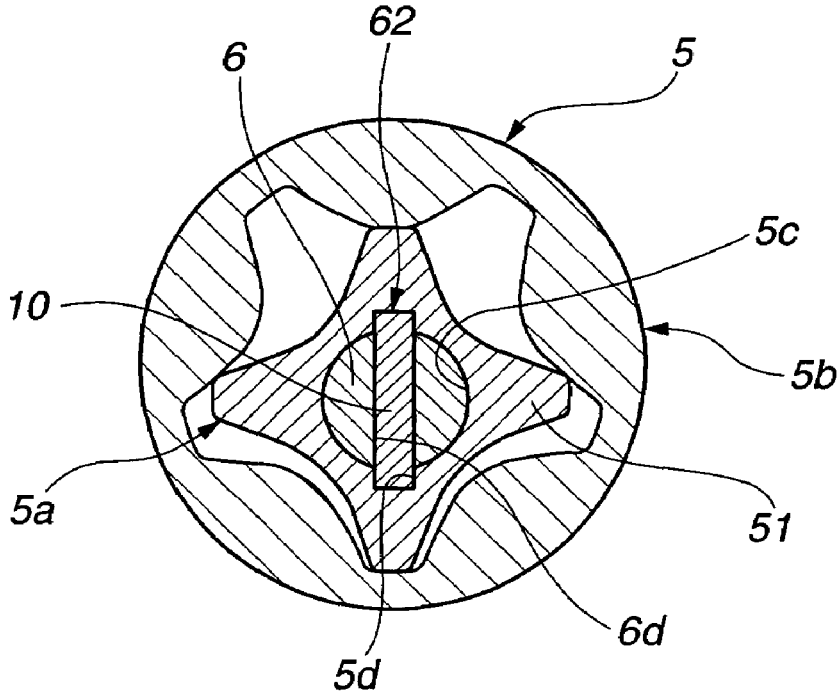
FIG. 8 is a cross-sectional view along line S8-S8 of FIG. 1, showing a second trochoid pump.

FIG. 8 is a cross-sectional view substantially taken on the line S8-S8 of FIG. 1, showing second trochoid pump 5. Second trochoid pump 5 is installed in housing cylinder 1 in tandem with the first trochoid pump 4 so as to be located at a position nearer to the opening portion 1*a* than first trochoid pump 4. Second trochoid pump 5 comprises a second inner rotor 5*a* functioning as a drive rotor and a second outer rotor 5*b* functioning as a driven rotor.

An insertion hole 5*c* for inserting the drive shaft 6 is formed at a center of second inner rotor 5*a*. A pin groove 5*d* of receiving a pin 10 penetrating the drive shaft 6 is formed on a spacer-facing surface of second inner rotor 5*a*.

Figure 9:
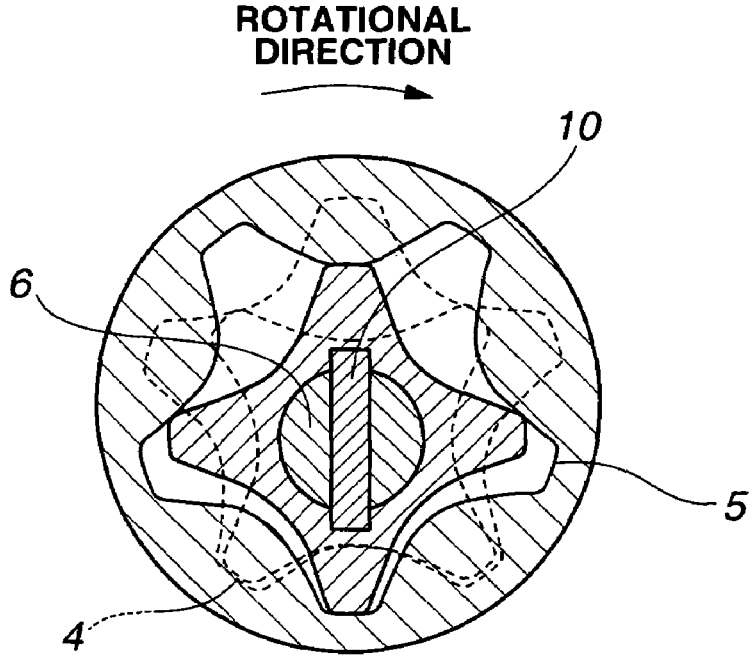
FIG. 9 is a view showing phases of gears of the first and second trochoid pumps.

FIG. 9 is a view showing phases of gears of first and second trochoid pumps 4 and 5. As is apparent from FIG. 9, the first and second trochoid pumps 4 and 5 are arranged such that an engaged position between first inner rotor 4*a* and first outer rotor 4*b* is offset from an engaged position between second inner rotor 5*a* and second outer rotor 5*b* by 36° in rotational angle. An arrow in FIG. 9 shows a rotational direction of drive shaft 6.

Drive shaft 6 has a second end portion 6*b* protruded from pump cover 2 to an outside of housing body 1. The second end portion 6*b* is press fitted into a center hole of a helical gear 7 to establish a fixed connection between drive shaft 6 and helical gear 7. Therefore, a rotational force of helical gear 7 is transmitted to first and second trochoid pumps 4 and 5.

Drive shaft 6 is constituted by a column member. First end portion 6*a* of drive shaft 6 has two cutaway faces to form a two-parallel-face portion (non-circular portion). A first fixing portion 61 for fixing the first inner rotor 4*a* to drive shaft 6 is therefore constructed by two-parallel-face portion 6*c* and engagement hole 4*c*.

Drive shaft 6 has a through hole 6*d* formed along the radial direction at a position corresponding to pin groove 5*d* of second inner rotor 5*a*. Pin 10 is inserted into the through hole 6*d*. A length of pin 10 is longer than a length of through hole 6*d*, and pin 10 is installed in through hole 6*d* so that both ends of pin 10 protrude from both ends of through hole 6*d*. A second fixing portion 62 for fixing the second inner rotor 5*a* to drive shaft 6 is constructed by through hole 6*d*, pin 10 and pin groove 5*d* of second inner rotor 5*a*.

A column-shaped portion of drive shaft 6 is supported by bearing portion 2*b* of pump cover 2 and bearing portion 3*a* of spacer 3.

Helical gear 7 transmits a rotational force of a crankshaft to drive shaft 6 through not-shown gears. In the first embodiment according to the present invention, helical gear 7 is install so that a thrust force directed in the direction shown by the white arrow in FIG. 1 is applied to drive shaft.

Subsequently, there is discussed the operation of the tandem type trochoid pump according to the first embodiment of the present invention.

When the engine is driven, the rotational force of the crankshaft is inputted to drive shaft 6 through helical gear 7. In replay to power transmission, first and second trochoid pumps 4 and 5 are driven.

When first trochoid pump 4 is driven, a suction chamber during an expansion stroke is put in a negative pressure state, and therefore engine oil stored in the oil pan is sucked into the suction chamber of first trochoid pump 4 through suction inlet 1*c* and suction port 12*a* of housing body 1, and suction port 32*a* of spacer 3.

The engine oil fed into the operation chamber of first trochoid pump 4 is pressurized in a discharge chamber during compression stroke, and is discharged from discharge outlet 1*d* through discharge port 12*b* of housing body 1 and discharge port 32*b* of spacer 3.

Similarly, when second trochoid pump 5 is driven, a suction chamber during an expansion stroke is put in a negative pressure state, and therefore engine oil stored in the oil pan is sucked into the suction chamber of second trochoid pump 5 through suction inlet 1*c* of housing body 1, suction port 21*a* of pump cover 2 and suction port 31*a* of spacer 3.

Engine oil fed to the operation chamber of second trochoid pump 5 is pressurized in a discharge chamber during compression stroke, and is discharged from discharge outlet 1*d* through the discharge port 21*b* of pump cover 2 and the discharge port 31*b* of spacer 3.

When the oil pump is driven, the thrust force directed from first end portion 6*a* to second end portion 6*b* is applied to drive shaft 6. Therefore, second inner rotor 5*a* rotates under a condition that second inner rotor 5*a* is pushed toward second-pump-facing surface 21 of pump cover 2 by pin 10.

In contrast to this condition, the first embodiment according to the present invention is arranged such that pin groove 5*d* is formed on spacer-facing surface 51 of second inner rotor 5*a*. Accordingly, by avoiding the contact of pin 10 relative to lubrication groove 2*c* of pump cover 2 and lubrication groove 3*b* of spacer 3, an increase of the friction due to the sliding of pin 10 on lubrication grooves 5*d* and 3*b* is prevented.

As discussed above, pin 10 rotates while being biased toward second-inner-rotor-facing surface 5*a* by the thrust force applied to drive shaft 6. Herein, if pin groove 5*d* is provided in a pump-cover-facing surface of second inner rotor 5 or pump cover 2, pin 10 rotates while directly contacting with pump cover 2 due to the thrust force. This excessively increases the load of pin 10 and will cause a problem of degrading the durability of the pump. However, since the first embodiment according to the present invention is arranged such that pin groove 5*d* is formed on a surface of second inner rotor 5*a* located at a side opposite to the thrust direction, it becomes possible to prevent pin 10 from rotating while sliding on other member.

Figure 10:
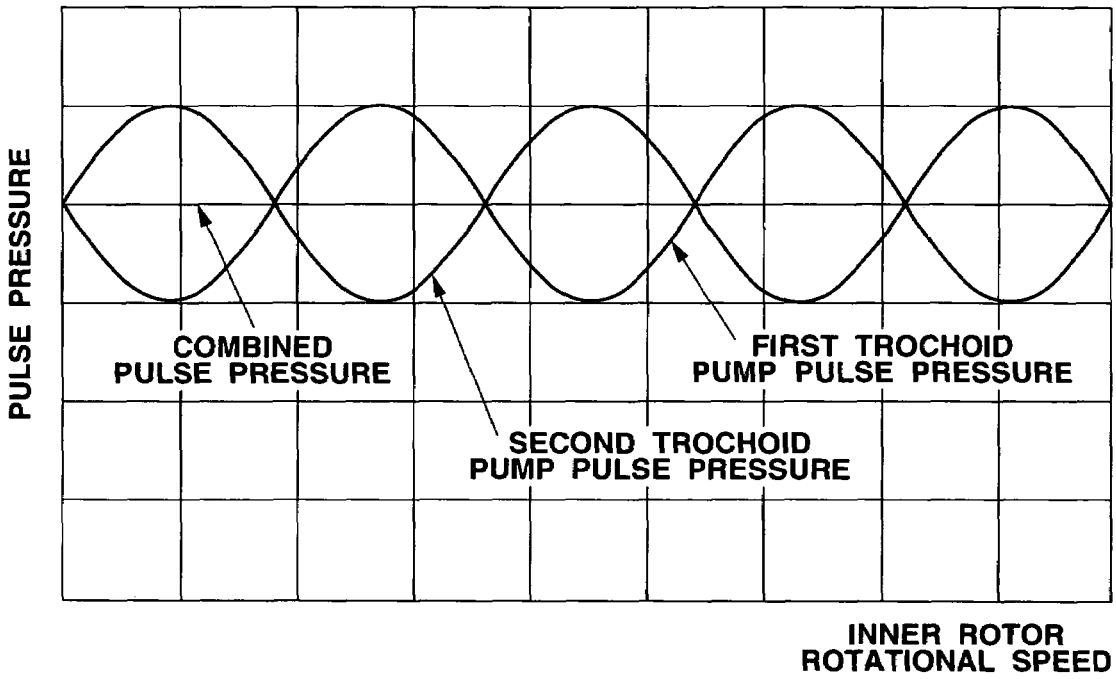
FIG. 10 is a graph showing a pulse pressure suppression operation of the first embodiment.

Since first and second trochoid pumps 4 and 5 are arranged such that the gear engagement position between the inner rotor and the outer rotor of one of first and second trochoid pumps 4 and 5 is offset from the gear engagement position of the inner rotor and the outer rotor of the other of first and second trochoid pumps 4 and 5 by 36° in rotational angle, the pulse pressures of first and second trochoid pumps 4 and 5 respectively have phases which function to cancel the pulse pressures with each other, as shown in FIG. 10. Accordingly, a combined pulse pressure of engine, whose pulse pressure is suppressed, is outputted from discharge outlet 1*d*.

Subsequently, there is explained a method of assembling the tandem type trochoid pump 4 of the first embodiment.

At first step of the assembling method, first inner rotor 4*a*, first outer rotor 4*b* and spacer 3 are in turn installed in housing body 1. That is, during this first step, the positioning of first trochoid pump 4 is executed.

Figure 11A:
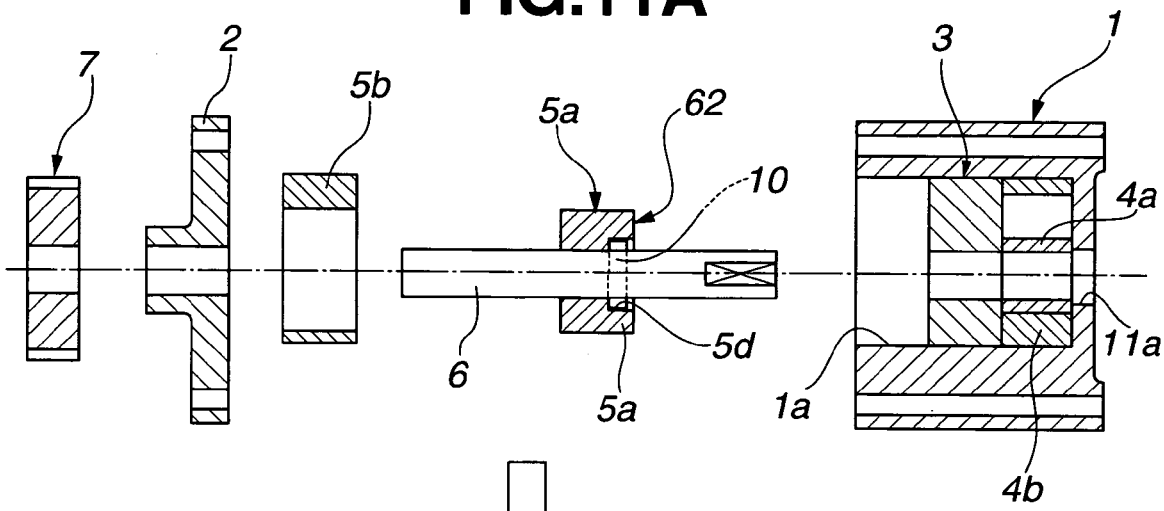
FIGS. 11A through 11D are views for explaining an assembly method of the trochoid pump discussed in the first embodiment.

At second step of the assembling method, pin 10 is inserted into through hole 6*d* of drive shaft 6. Pin 10 is installed relative to through hole 6*d* so that both ends of pin 10 protrude from both ends of through hole 6*d*. Then, drive shaft 6 is inserted into insertion hole 5*c* of second inner rotor 5*a* from a side of spacer 3. By executing this second step, drive shaft 6 and second inner rotor 5*a* are integrally connected at second fixing portion 62 as shown in FIG. 11A. By the execution of the second step, a sub-assembly unit shown at a rightmost portion in FIG. 11A is produced.

At third step of the assembling method, the sub-assembled unit is installed so that opening portion 1*a* of housing body 1 is positioned at an uppermost position. Therefore, first end portion 6*a* of drive shaft 6 is inserted into bearing portion 3*a* of spacer 3 and engagement hole 4*c* of first inner rotor 4*a*. Since a lower side of second inner rotor 5*a* is supported by pin 10 during the insertion process of drive shaft 6 into first inner rotor 4*a*, second inner rotor 5*a* is firmly installed at a correct position in housing body 1 without dropping off from drive shaft 6. By executing this third step, first inner rotor 4*a* and engagement hole 4*c* are fixed in the rotational direction, by means of first fixing portion 61.

At fourth step of the assembling method, second outer rotor 5*b* is installed in housing body 1 so as to receive second inner rotor 5*a* therein. By executing this fourth step, second trochoid pump 5 is positioned at a correct position.

Figure 11B:
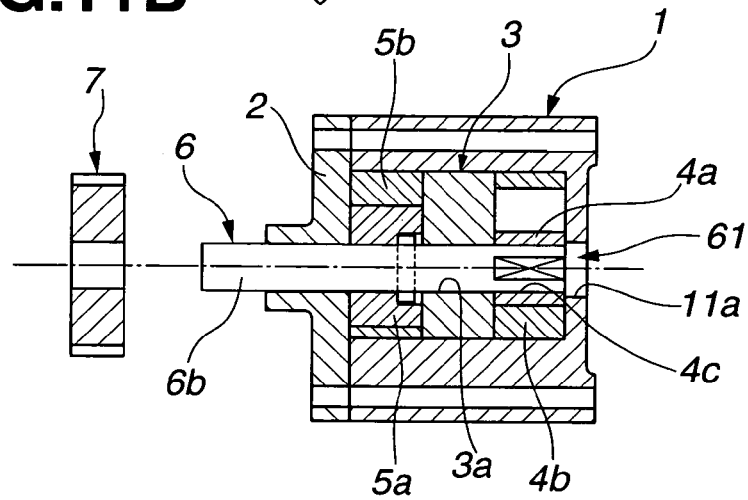
Figure 11C:
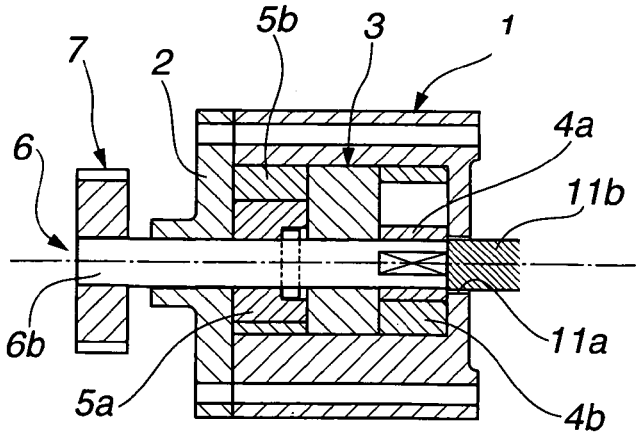
Figure 11D:
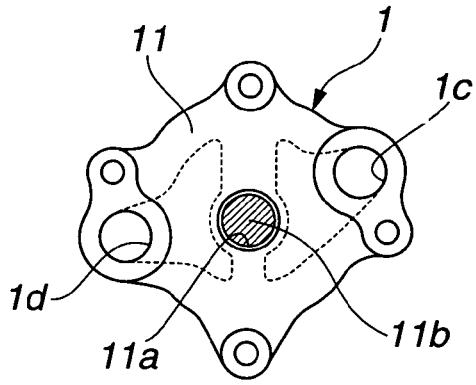
Figure 12:
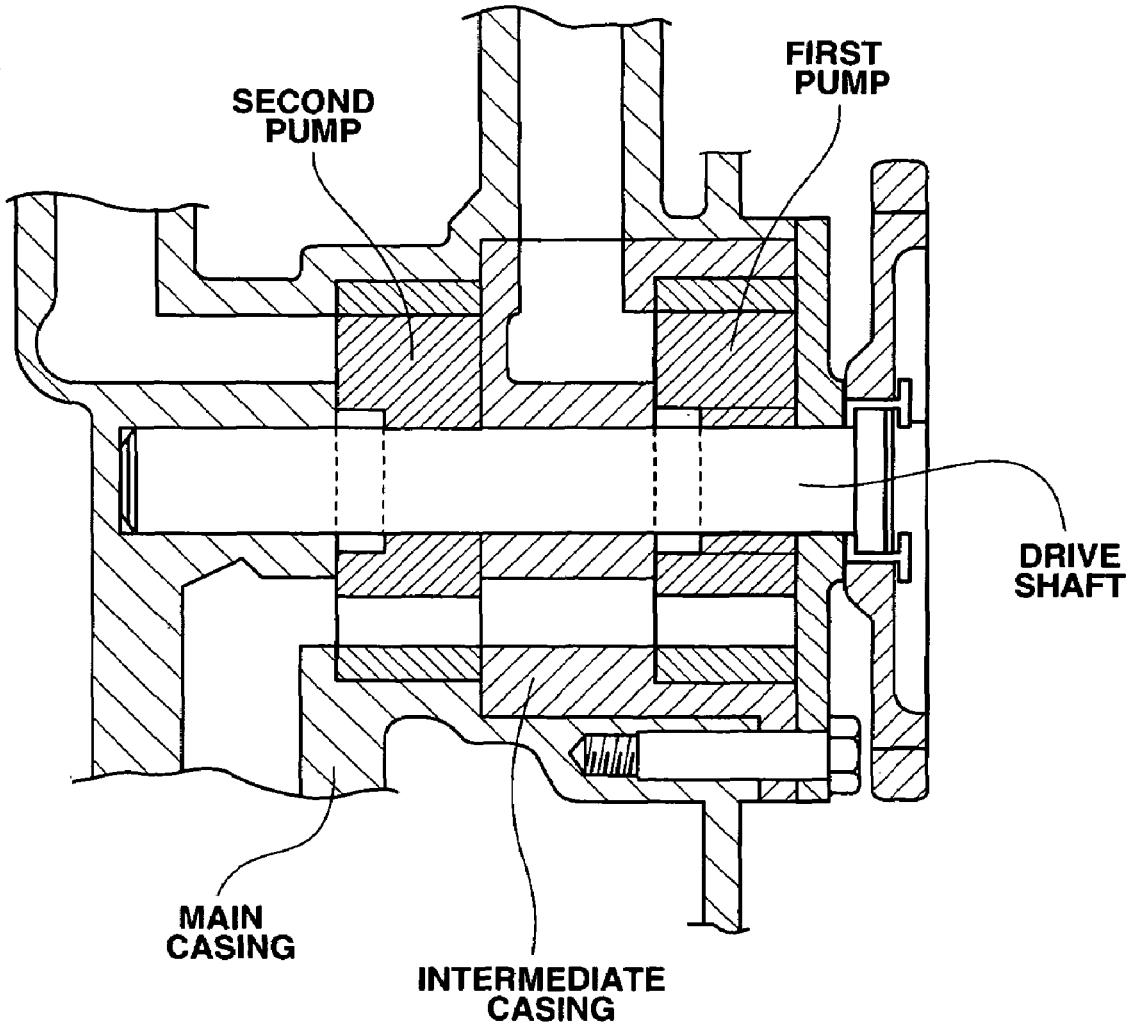
FIG.12 (RELATED ART)
FIG. 12 is a cross-sectional view showing a commonly known oil pump which has an intermediate housing.

At fifth step of the assembling method, pump cover 2 is installed on opening portion 1*a* of housing body 1 as shown in FIG. 11B. Then, as shown in FIGS. 11C and 11D, a press-fit supporting jig 11*b* is inserted in housing body 1 from insertion hole 11*a* formed at bottom portion 11 of housing body 1 and supports first end portion 6*a* of drive shaft 6. While keeping this supporting state, helical gear 7 is press fitted with second end portion 6*b* of drive shaft 6. Since first end portion 6*a* of drive shaft 6 is supported by press-fit supporting jig 11*b*, contact between first end portion 6*a* and housing body 1 is avoided. This contact avoidance prevents a deformation of the housing body during the press-fitting operation of helical gear 7.

Hereinafter, there is discussed the advantages of the assembling method of the tandem type trochoid pump according to the present invention, by comparing with a commonly known tandem type trochoid pump.

Conventionally, a known oil pump having two trochoid pumps has been assembly such that each rotor is integrally connected to a drive shaft by means of pins inserted into the drive shaft, then the sub-assembled drive shaft and the rotors are installed in a housing body while executing a positioning of each rotor relative to a corresponding outer rotor.

Since this known oil pump requires an assembly operation of respectively inserting gears of the two rotors having different phases into the corresponding outer rotors and of simultaneously executing the positioning of the two outer rotors relative to the housing body in the assembly operation, the assembly operation becomes very complicated and delicate, and therefore the workability during the assembly operation is degraded.

In order to solve the above problem, Japanese Published Utility Model (Heisei) 3-5990 has proposed an oil pump which is assembled by employing a sub-assembly of installing a second trochoid pump in an intermediate casing. By employing this sub-assembly, when the drive shaft is installed in the casing body, it becomes not necessary to executing the positioning of second trochoid pump relative to a casing. This facilitates the assembly operation.

However, since this known art requires an intermediate casing in addition to the casing body, there is caused a problem that the size of the housing body becomes large.

In contrast, the method of assembling the tandem type trochoid pump A of the first embodiment according to the present invention is achieved by executing the following fifth step: At the first step, first inner rotor 4*a*, first outer rotor 4*b* and spacer 3 are installed in housing body 1. At the second step, drive shaft 6 and second inner rotor 5*a* are fixed by means of second fixing portion 62. At the third step, the drive shaft 6 is assembled with housing body 1, and driving shaft 6 and first inner rotor 4*a* are fixed by means of first fixing portion 61. At the fourth step, second outer rotor is assembled. At the fifth step, pump cover 2 is attached to housing body 1.

By executing the above steps, first inner rotor 4*a*, first outer rotor 4*b*, spacer 3, second inner rotor 5*a*, drive shaft 6 and second outer rotor 5*b* are assembled with housing body 1 in the one direction.

Since the positioning operations of first and second trochoid pump 4 and 5 are executed in different steps, respectively, the workability of the assembly operation is largely improved as compared with that of the above-discussed known method. Additionally, since the pump according to the present invention does not require an intermediate casing for a sub-assemble, it becomes possible to decrease the size of the pump according to the present invention small as compared with the pump disclosed in Japanese Published Utility Model (Heisei) 3-5990.

Subsequently, there is discussed the effects of the present invention. The tandem type trochoid pump according to the first embodiment of the present invention obtains the following effects.

(1) The pump comprises the drive shaft 6 having the two-parallel-surface portion 6*c* at the first end portion 5*a*, the spacer 3 partitioning the space in the housing body 1 into a first space for first trochoid pump 4 and a second space for second trochoid pump 5, the first fixing portion 61 constructed by the engagement hole 4*c* of first inner rotor 4*a* and the two-parallel-surface portion 6*c*, and the second fixing portion 62 constructed by the through hole 6*d*, the pin 10 and the pin groove 5*d* of second inner rotor 5*a*. Therefore, it becomes possible to assemble all parts in the one direction relative to housing body 1 and to facilitate the positioning operation of each part. This improves the workability of the assembly operation without increasing the size of the housing body.

(2) Since pin 10 protrudes from both ends of through hole 6*d* penetrating the drive shaft 6, it becomes possible to receive the rotational force applied to pin 10 at the protruding portions of pin 10 while dispersing the force at both protruding portions of pin 10. This improves the durability of pin 10 as compared with the case that the rotational force is received by one end portion of pin 10. Further, since the provisional assembly of drive shaft 6, second inner rotor 5*a* and pin 10 keeps an assemble state without exploded into each part, it is easily assembled with housing body 1.

(3) The assembly method of the tandem type trochoid pump A is constructed by the first step of installing the first inner rotor 4*a*, the first outer rotor 4*b* and the spacer 3 in housing body 1, the second step of integrally connecting the drive shaft 6 and the second inner rotor 5*a* by means of second fixing portion 62, the third step of inserting the drive shaft 6 integrated with the second inner rotor 5*a* into the spacer 3 and the first inner rotor 4*a* and fixing the drive shaft 6 and the first inner rotor 4*a* in the rotational direction by means of the first fixing portion 61, and the fourth step of installing the second outer rotor 5*b* in the housing body 1 so that the second outer rotor 5*b* receives the second inner rotor 5*a* therein. Therefore, it becomes possible to assemble all parts in the one direction relative to housing body 1 and to facilitate the positioning operation of each part. This improves the workability of the assembly operation without increasing the size of the housing body.

(4) Drive shaft 6 is constructed such that only the first end portion 5*a* is the two-parallel-surface portion 6*c* formed by partially cutting away a column shaft, and the part received by pump cover 2 and spacer 3 is a column part. Therefore, it becomes possible to decrease a pressure applied on a unit surface of drive shaft 6 and a wobbling of drive shaft 6.

(5) Lubrication groove 3*b* for lubricating the bearing portion 3*a* at first-pump-facing surface 32 of spacer 3. That is, if a lubrication groove is formed on the second-pump-facing surface 31 of spacer 3, the surface pressure is increased by the sliding of pin 10 on the lubrication groove and therefore the friction increases. In contrast to this, by forming the lubrication groove on first-pump-facing surface 32, it becomes possible to avoid the contact between lubrication groove 3*b* and pin 10.

(6) Since pin groove 5*d* is formed on spacer-facing surface 51 of second inner rotor 5*a*, it becomes possible to prevent pin 10 form rotating while sliding on an adjacent member, due to the thrust force.

Although the tandem type trochoid pump according to the present invention has been shown and described on the basis of the first embodiment, the concrete construction of the present invention is not limited by the construction described in the first embodiment, and a modification or design change may be made without departing from the scope of the invention.

Figure 13:
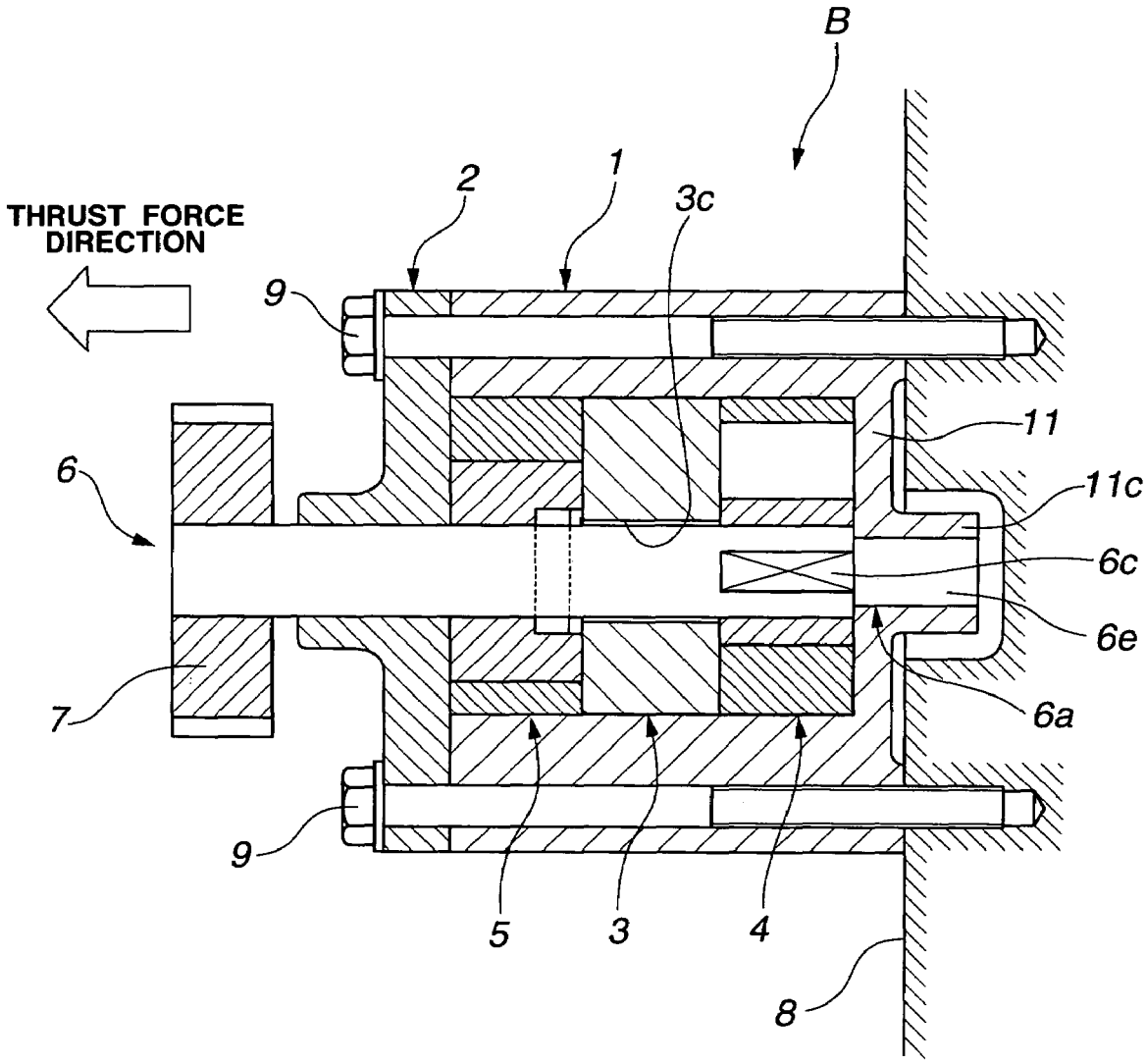
FIG. 13 is a modification of the tandem type trochoid pump of the first embodiment.

For example, a bearing portion of drive shaft 6 may be formed in housing body 1. FIG. 13 is a cross-sectional view showing a tandem type trochoid pump B. This pump B is specifically arranged such that an inner circumference 3*c* of spacer 3 is not contacted with drive shaft 6, a bearing portion 11*c* protrudes from bottom portion 11 of housing body 1 outwardly, and an inner circumference of bearing portion 11*c* rotatably supports a non-bearing portion 6*e* extendedly formed from first end portion 6*a* of drive shaft 6.

Figure 14:
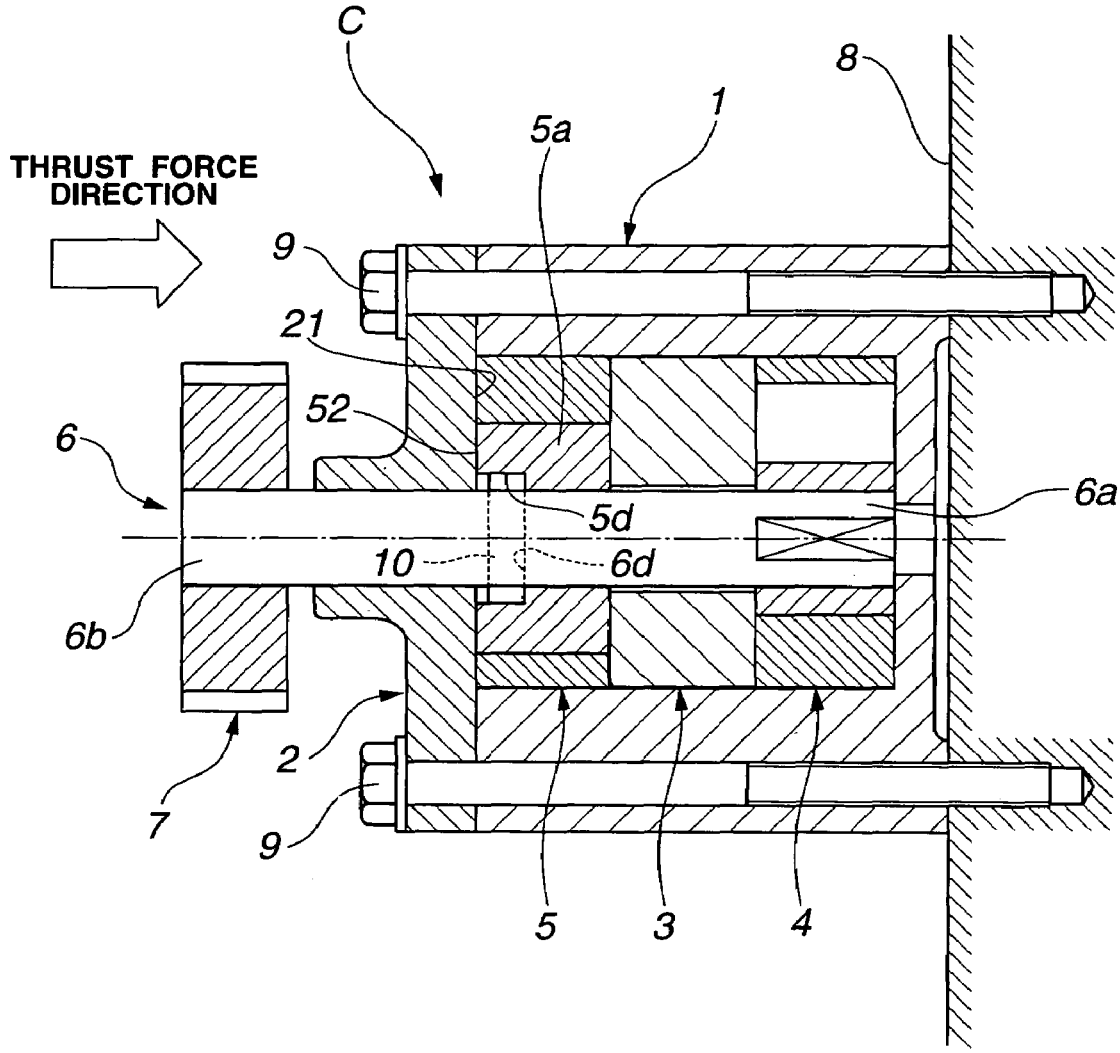
FIG. 14 is another modification of the tandem type trochoid pump of the first embodiment.

In case that the thrust force of helical gear 7 is applied in the direction opposite to the direction applied in the first embodiment, the pump may be constructed such that pin groove 5*d* of second fixing portion is formed on a pump-cover-facing surface of second inner rotor 5*a* to avoid the contact between pin 10 and spacer 53, as shown by a tandem type trochoid pump D in FIG. 14.

This application is based on Japanese Patent Applications No. 2004-351887 filed on Dec. 3, 2004 in Japan. The entire contents of this Japanese Patent Application is incorporated herein by reference.

Although the invention has been described above by reference to certain embodiments of the invention, the invention is not limited to the embodiments described above. Modifications and variations of the embodiments described above will occur to those skilled in the art, in light of the above teaching. The scope of the invention is defined with reference to the following claims.

What is claimed is:

1. A tandem type trochoid pump comprising:

a housing body of a cylindrical shape comprising an opening end portion and a bottom end portion;

a pump cover sealing the opening end portion;

a first trochoid pump disposed adjacent to the bottom end portion, the first trochoid pump comprising a first inner rotor and a first outer rotor;

a second trochoid pump disposed adjacent to the opening end portion in tandem with the first trochoid pump, a phase of the second trochoid pump being different from a phase of the first trochoid pump, the second trochoid pump comprising a second inner rotor and a second outer rotor;

a drive shaft comprising a non-circular end portion, the drive shaft receiving a rotational force at the other end portion thereof;

a spacer disposed between the first and second trochoid pumps in the housing body, the drive shaft rotatably penetrating the spacer;

a first fixing portion for fixing the first inner rotor to the drive shaft in a rotational direction of the drive shaft, the first fixing portion being constructed by the non-circular end portion and a non-circular hole which is formed at an inner circumference of the first inner rotor and engageable with the non-circular portion; and a second fixing portion for fixing the second inner rotor to the drive shaft in the rotational direction of the drive shaft, the second fixing portion being constructed by a through hole which is formed at a second-inner-rotor position of the drive shaft and which extends in a diametrical direction of the drive shaft, a pin which is inserted in the through hole, and a pin groove which is formed on the second inner rotor and which is engaged with the pin.

2. The tandem type trochoid pump as claimed in claim 1, wherein the through hole penetrates the drive shaft, and the pin protrudes from both ends of the through hole.

3. The tandem type trochoid pump as claimed in claim 1, wherein the drive shaft is constructed by a column shaft whose non-circular end portion is formed by partially cutting away the drive shaft, and the drive shaft is rotatably supported at least by the pump cover.

4. The tandem type trochoid pump as claimed in claim 3, wherein the non-circular end portion of the drive shaft is formed into a two-parallel-surface shape.

5. The tandem type trochoid pump as claimed in claim 3, wherein a column shaped portion of the drive shaft is rotatably supported by the spacer.

6. The tandem type trochoid pump as claimed in claim 5, wherein the spacer comprises a lubrication groove for lubricating a bearing portion between the drive shaft and the spacer.

7. The tandem type trochoid pump as claimed in claim 3, wherein a discharge port and a suction portion of the second trochoid pump are formed on the pump cover, and a lubrication groove for fluidly communicating a bearing portion of the pump cover and the discharge port is formed on the pump cover.

8. The tandem type trochoid pump as claimed in claim 1, wherein the tandem type trochoid pump is used as an oil pump for lubricating an internal combustion engine.

9. The tandem type trochoid pump as claimed in claim 1, wherein the drive shaft is driven by a helical gear fixed thereto, the helical gear producing a thrust force directed in a direction from the pump cover toward the helical gear.

10. The tandem type trochoid pump as claimed in claim 1, wherein the housing body has a suction inlet and a discharge outlet which are formed along an axial direction of the housing body.

11. The tandem type trochoid pump as claimed in claim 10, wherein a first suction port and a first discharge port of the first trochoid pump are formed on one surface of the spacer, and a second suction port and a second discharge port of the second trochoid pump are formed on the other surface of the spacer, the first and second suction ports being communicated with the suction inlet and the first and second discharge ports being communicated with the discharge outlet.

12. The tandem type trochoid pump as claimed in claim 1, wherein the bottom end portion of the housing body has a non-contact hole for putting the non-circular end portion of the drive shaft in a non-contact state relative to the housing body.

13. The tandem type trochoid pump as claimed in claim 12, wherein a jig is capable of being inserted into the non-contact hole.

14. The tandem type trochoid pump as claimed in claim 1, wherein the first trochoid pump and the second trochoid pump are offset with each other in rotational angle so as to cancel pulse pressures thereof with each other.

15. The tandem type trochoid pump as claimed in claim 1, wherein the spacer and the drive shaft are supported by inner circumferences of the housing body, and a receiving portion extending from the non-circular end portion of the drive shaft is rotatably supported by a bearing portion formed at the bottom end portion of the housing body so that the spacer and the drive shaft are put in a non-contact state with each other.

16. The tandem type trochoid pump as claimed in claim 1, wherein the drive shaft is driven by a helical gear, the helical gear producing a thrust force directed in a direction from the helical gear to the housing body, the pin groove being formed on a surface of the second inner rotor, which surface faces with the pump cover.

17. The tandem type trochoid pump as claimed in claim 1, wherein the housing body is fixedly connected to the pump cover by means of bolts, the bolts being tightened in an engine block through the pump cover and the housing body.

18. A method of assembling a tandem type trochoid pump which comprises a housing body of a cylindrical shape comprising an opening end portion and a bottom end portion; a pump cover sealing the opening end portion of the housing body; a first trochoid pump disposed adjacent to the bottom end portion and comprising a first inner rotor and a first outer rotor; a second trochoid pump disposed adjacent to the opening end portion in tandem with the first trochoid pump, a phase of the second trochoid pump being different from a phase of the first trochoid pump, the second trochoid pump comprising a second inner rotor and a second outer rotor; a drive shaft comprising a non-circular end portion, the drive shaft receiving a rotational force at the other end portion thereof; a spacer which is disposed between the first and second trochoid pumps in the housing body, the drive shaft rotatably penetrating the spacer; a first fixing portion for fixing the first inner rotor to the drive shaft in a rotational direction of the drive shaft, the first fixing portion being constructed by the non-circular end portion and a non-circular hole which is formed at an inner circumference of the first inner rotor and engageable with the non-circular portion; and a second fixing portion for fixing the second inner rotor to the drive shaft in the rotational direction of the drive shaft, the second fixing portion being constructed by a through hole which is formed at a second-inner-rotor position of the drive shaft and extends in a diametrical direction of the drive shaft, a pin which is inserted in the through hole, and a pin groove which is formed on the second inner rotor and which is engaged with the pin, the method comprising the steps of:

a first step of installing the first outer rotor, the first inner rotor and the spacer in the housing body;

a second step of inserting the drive shaft in the second inner rotor and integrally connecting the drive shaft and the second inner rotor by means of the second fixing portion;

a third step of inserting the drive shaft in the spacer and the first inner rotor and fixedly connecting the drive shaft and the first inner rotor in the rotational direction of the drive shaft by means of the first fixing portion; and a fourth step of installing the second outer rotor in the housing body.

19. The method as claimed in claim 18, further comprising a step of press-fitting a helical gear with the drive shaft under a condition that a jig is inserted into a non-contact hole which is formed at the bottom end portion, so as to put the non-circular end portion of the drive shaft in a non-contact state relative to the housing body.

* * * * *